United States Patent [19]

Matsuura et al.

[11] Patent Number: 4,514,483

[45] Date of Patent: Apr. 30, 1985

[54] METHOD FOR PREPARATION OF SELENIUM TYPE ELECTROPHOTOGRAPHIC ELEMENT IN WHICH THE SUBSTRATE IS SUPERFINISHED BY VIBRATING AND SLIDING A GRINDSTONE

[75] Inventors: Tadashi Matsuura; Yasuo Kadomatsu, both of Yokohama, Japan

[73] Assignee: Ricoh Co., Ltd., Tokyo, Japan

[21] Appl. No.: 480,601

[22] Filed: Mar. 30, 1983

[30] Foreign Application Priority Data

Apr. 2, 1982 [JP] Japan ..... 57-55114

[51] Int. Cl.[3] ..... G03G 5/08; G03G 5/04; G03G 5/00

[52] U.S. Cl. ..... 430/84; 51/281 R; 430/62; 430/63; 430/69; 430/127

[58] Field of Search ..... 430/62, 63, 69, 127; 51/281 R

[56] References Cited

U.S. PATENT DOCUMENTS 2,090,274 8/1937 Walker et al. ..... 51/281 R 4,134,763 1/1979 Fujimura et al. ..... 51/281 R

*Primary Examiner*—John E. Kittle

*Assistant Examiner*—Mukund J. Shah

*Attorney, Agent, or Firm*—Flynn, Thiel, Boutell & Tanis

[57] ABSTRACT

The present invention provides a method for preparing a selenium type electrophotographic element comprising the steps of processing the surface of an electrically conductive substrate which has a metal surface by vibrating and sliding a grindstone until a predetermined surface-roughness is obtained and thereafter vapor-depositing thereon selenium, selenium alloy or selenium compound in a usual manner.

4 Claims, 3 Drawing Figures

| | | | | | |
|---|---|---|---|---|---|
| SURFACE - ROUGHNESS Rz | 0.4 TO 1.0 μm | 0.02 TO 0.80 μm | 0.02 TO 0.06 μm | 0.05μm OR MORE TO LESS THAN 0.30μm | 0.30 TO 2.00 μm |
| PROCESS | SUPER -FINISHING | (NOTE) CUTTING | CUTTING AND ETCHING | SUPER-FINISHING | |
| ELECTRO-PHOTOGRAPHIC ELEMENT | Se-Te ALLOY TYPE | $As_2-Se_3$ TYPE | | | |

NOTE: NOT MEASURED BECAUSE THE VAPORDEPOSITED LAYER FORMED BY VAPORDEPOSITION WAS PARTIALLY PEELED OFF.

METHOD FOR PREPARATION OF SELENIUM TYPE ELECTROPHOTOGRAPHIC ELEMENT IN WHICH THE SUBSTRATE IS SUPERFINISHED BY VIBRATING AND SLIDING A GRINDSTONE

BACKGROUND OF THE INVENTION (a) Field of the Invention

The present invention relates to processing of an electrically conductive substrate in a method for the preparation of a selenium type electrophotographic element.

(b) Description of the Prior Art

Methods for preparing selenium type electrophotographic elements have hitherto been known which comprise the steps of turning or buffing the surface of an electrically conductive substrate which has a metal surface until its surface-roughness Rz (according to JIS-B0601) becomes 0.01 to 0.4 μm (that is from 0.01 μm or more to 0.4 μm or less), then etching the same and thereafter vapordepositing thereon selenium, selenium alloy or selenium compound (which will be called "selenium type" for short hereinafter); or the steps of subjecting the surface of said substrate to super-finishing (a processing method using vibration and sliding of a grindstone) until its surface-roughness becomes 0.3 to 2.0 μm and thereafter forming a selenium type-vapordeposit layer in the same manner as mentioned above. However, both methods include difficult points in the preparation. The former method is defective in the following points (1) the cost of equipment increases because an etching treatment is needed in addition to surface processing, (2) the characteristics of the elemenet such as external appearance, adhesive property and the like are not uniform because control of the etching liquid during the etching treatment is difficult and thus the pit state (surface-roughness) varies as the liquid concentration varies, (3) a part to be cut is required in processing for regeneration, and therefore the number of regenerations is about one at most and repeated regeneration is difficult, and (4) in case $As_2Se_3$ is used in the vapordeposit layer, when conducting an etching treatment in processing for regeneration, a small amount of $As_2Se_3$ adhering to the surface other than the regeneration-processed (or turned) surface dissolves in the treating liquid and generates gas which inflicts bodily injury on a person, whereby expensive equipment is required for treating this poisonous gas. On the other hand, the latter method is free from the drawbacks inherent in the etching treatment but is defective in that when $As_2Se_3$ vapordeposit layer is superimposed on the surface of the substrate after processing, a large number of projections occur on the surface of the vapordeposit layer and injure the blade for toner cleaning when matching the obtained element with an electrophotographic copying machine, whereby the obtained copy deteriorates in quality. The number of projections generated depends on the degree of surface-roughness of the substrate. In case Rz is 0.3 to 2.0 μm, the obtained element, even if the vapordeposit layer is processed, is not permissible from the aspect of its matchability with an electrophotographic copying machine.

SUMMARY OF THE INVENTION

The object of the present invention is to provide a method for preparing a selenium type electrophotographic element which is capable of eliminating the drawbacks inherent in the etching treatment as well as improving its matching property with an electrophotographic copying machine by suppressing the occurrence of projections on the surface of a vapordeposit layer, and further, possesses the properties suitable for an electrophotographic process such as surface-smoothness and adhesiveness.

The method for preparing a selenium type electrophotographic element according to the present invention comprises physically or chemically processing the surface of an electrically conductive substrate which has a metal surface and thereafter superimposing a selenium, selenium alloy or selenium compound-vapordeposit layer thereon, which method is characterized in that said surface processing is conducted by vibrating and sliding a grindstone until its surface-roughness Rz according to JIS-B0601 falls within the range of from 0.05 μm or more to less than 0.3 μm.

We have noticed that of the hitherto employed substrate surface-processing methods, super finishing can dispense with any etching treatment which is accompanied by various drawbacks, and have carried out a series of investigations in the super finishing thereby to discover that when processed so that the surface-roughness Rz may be in the range of from 0.05 μm or more to less than 0.3 μm, the number of projections is reduced exceedingly and consequently the element obtained by processing the surface layer after vapordeposition has been completed is permissible in the point of matching with an electrophotographic copying machine. Further, we have discovered that by using the thus surface-processed substrate there can be obtained a selenium type, in particular $As_2Se_3$ electrophotographic element which can satisfy the surface smoothness called for from the aspect of electrophotographic process and the adhesiveness between the substrate and the vapordeposit layer. The present invention has been completed on the basis of these findings.

DETAILED DESCRIPTION OF THE PREFERRED EMBODIMENTS

Figure 1:
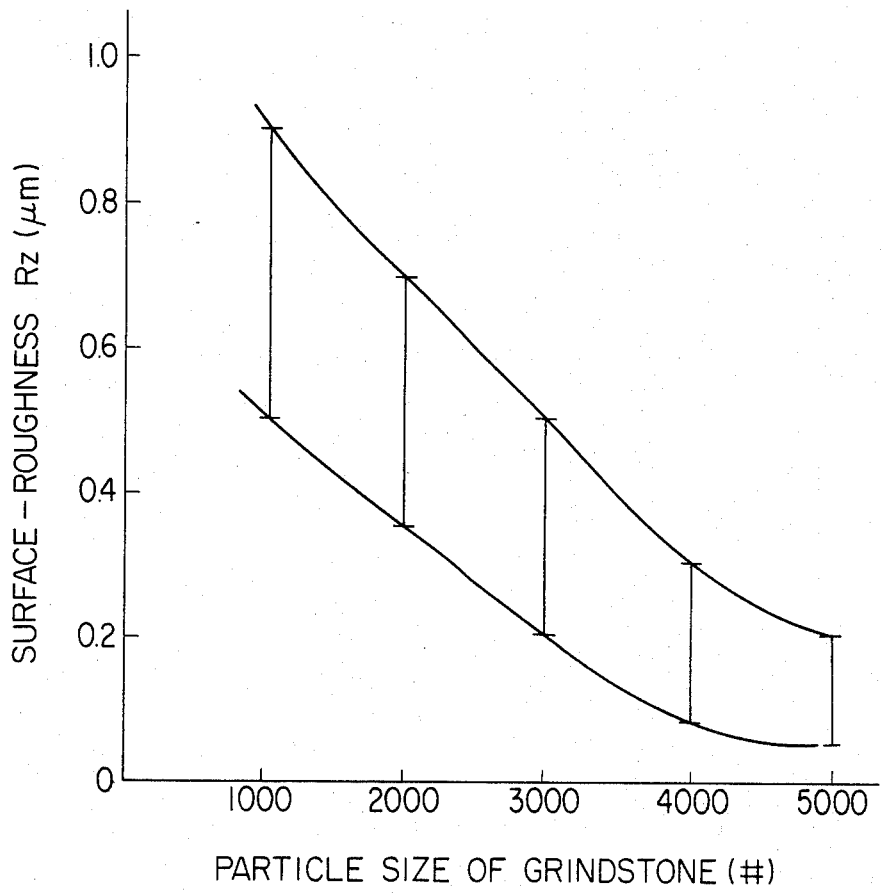
FIG. 1 is a view illustrating the relationship between the particle size of a grindstone used in the method according to the present invention and the roughness of the Al substrate obtained by a cutting process using the grindstone.

The method according to the present invention comprises first cutting the surface of an electrically conductive substrate which has a metal surface of Al, stainless steel or the like so that the surface-roughness Rz preferably may be in the range of 1 to 6 μm, and thereafter grinding the surface of said substrate by sliding, while vibrating, a grindstone thereon, the particle size of said grindstone being capable of obtaining the surface-roughness Rz in the range of from 0.05 μm or more to less than 0.3 μm. In this instance, said sliding may be done by either moving the grindstone itself or moving the substrate. The surface-roughness of the substrate is determined mainly by the particle size of the grindstone (which see FIG. 1, for instance the surface-roughness Rz of minimum 0.05 μm can be obtained by using the grindstone whose particle size is #5000.), but said surface-roughness Rz can be controlled additionally by the amplitude, pressure and moving speed of the grindstone at the time of processing (or by the moving speed of the substrate). Next, a selenium type material such as Se, Se-Te alloy, $As_2Se_3$ or the like is vacuum vapor-deposited, in a usual manner, on the substrate in the thickness of about 40 to 80 μm, said substrate having been processed so as to have a predetermined surface-roughness.

The grindstone used in the present invention is made by binding the particles of black silicon carbide, blue silicon carbide, brown aluminum oxide, white aluminum oxide or the like with a binding agent composed of polyvinyl alcohol and a thermo-setting resin.

Figure 2:
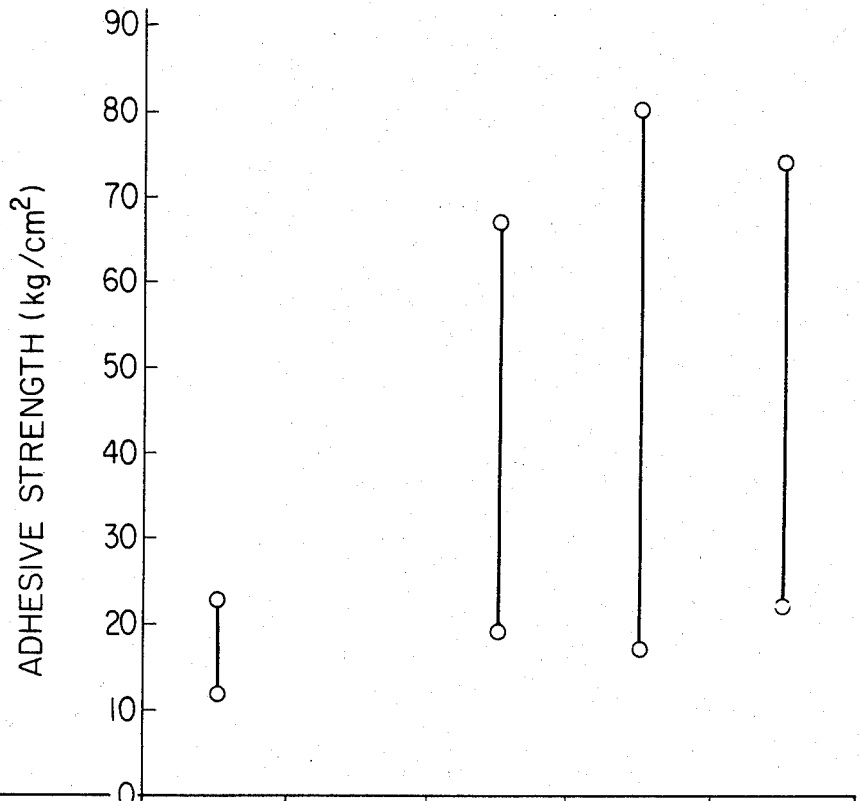
FIG. 2 is a view illustrating the relationship between the surface-roughness of the Al substrate caused by processing two kinds of electrophotographic elements differently and the adhesive strength between the vapordeposit layer and the substrate thereof.
Figure 3:
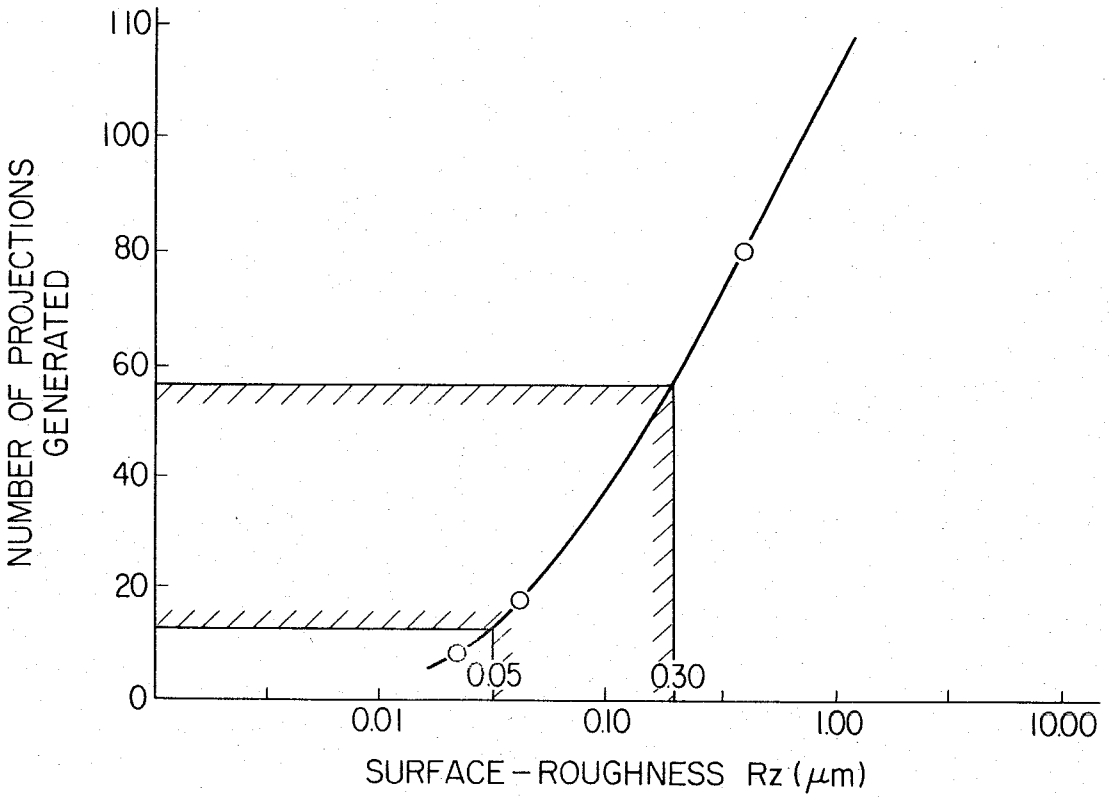
FIG. 3 is a view illustrating the relationship between the surface-roughness of the Al substrate obtained by cutting in accordance with the method of the present invention and the number of projections generated on the surface, after the completion of processing, of the electrophotographic element obtained by superimposing an $As_2Se_3$ vapordeposit layer on this substrate.

The surface of the substrate obtained by super-finishing according to the present invention displays a complicated configuration with grinding marks crossing each other thereon, and is exceedingly improved in the adhesive strength to the vapordeposit layer in comparison with that of the same level of surface-roughness obtained by a physical or chemical processing method using another cutting (which see FIG. 2). The number of projections generated on the surface of the selenium type electrophotographic element obtained by using the substrate whose surface-roughness Rz has been superfinished in the range of from 0.05 μm or more to less than 0.3 μm, is reduced to such an extent that the obtained element is permissible from the aspect of matchability with an electrophotographic copying machine (which see FIG. 3, and this figure relates to the instance of using an $As_2Se_3$ type electrophotographic element where measurement has been made on the conditions that measured area: 0.8 $mm^2$ and projections: those having the diameter of 20 μm or more.). In case the surface-roughness Rz of the substrate is less than 0.05 μm, it is not suitable for mass production because its surface processing occupies much time.

In case the surface-roughness Rz is 0.3 μm or more, whilst, a large number of projections are generated, thereby resulting in the problem to settle in the point of matching with an electrophotographic copying machine.

The present invention will be explained hereinafter with reference to examples.

EXAMPLE

The surface of an Al pipe (JIS-A300TD) was first ground until its surface-roughness Rz became 4 to 6 μm, and thereafter was further ground by vibrating and sliding a grindstone (particle size: #4000) thereon, thereby obtaining an electrically conductive substrate having a surface-roughness Rz of from 0.05 μm or more to less than 0.3 82 m. Next, $As_2Se_3$ was vacuum vapor-deposited on the processed surface of the substrate on the conditions that substrate temperature: 230° C. and vapor source temperature: 400° C., thereby forming a 65 μm-thick vapordeposit layer. The thus obtained selenium type electrophotographic element was superior in respect of the adhesiveness between the substrate and the vapordeposit layer, and the number of projections generated on the surface of said element was reduced to such an extent that the element is permissible from the aspect of matchability with an electrophotographic copying machine.

COMPARATIVE EXAMPLE

A selenium type electrophotographic element was prepared by repeating the same procedure as Example 1 except that the grinding was conducted using a grindstone (particle size: #1000) until the surface-roughness Rz became 0.3 to 2.0 μm. This electrophotographic element was superior in respect of the adhesiveness between the substrate and the vapordeposit layer, but the number of projections generated on the surface of the element was increased to such an extent not permissible from the aspect of matchability with an electrophotographic copying machine.

We claim:

1. A method for preparing an electrophotographic element which includes an electrically conductive substrate having a metal surface and a photoconductive layer on said substrate, which method comprises the steps of: superfinishing said metal surface of said substrate, using a grindstone effective for superfinishing, by placing said grindstone in contact with said metal surface, vibrating said grindstone, and effecting relative sliding movement between said metal surface and said vibrating grindstone until the surface roughness of said metal surface is from 0.05 μm to less than 0.3 μm whereby to obtain a superfinished metal surface; and then vapor-depositing $As_2Se_3$ on said superfinished metal surface to form said photoconductive layer consisting essentially of $As_2Se_3$.

2. A selenium type electrophotographic element prepared by the method according to claim 1.

3. A method according to claim 1 wherein, prior to said superfinishing step, said metal surface of said substrate has been ground so as to have a surface roughness of from 1 to 6 μm.

4. A method according to claim 1 wherein said grindstone is comprised of particles of a member selected from the group consisting of black silicon carbide, blue silicon carbide, brown aluminum oxide, and white aluminum oxide, in a binder of polyvinyl alcohol and a thermo-setting resin.

* * * * *